US006451168B1

(12) United States Patent
Talja

(10) Patent No.: US 6,451,168 B1
(45) Date of Patent: Sep. 17, 2002

(54) METHOD AND APPARATUS FOR MAKING PATTERNED PAPER

(75) Inventor: Martti Talja, Mänttä (FI)

(73) Assignee: Metsa-Serla Oyj, Espoo (FI)

( * ) Notice: Subject to any disclaimer, the term of this patent is extended or adjusted under 35 U.S.C. 154(b) by 0 days.

(21) Appl. No.: 09/598,052

(22) Filed: Jun. 21, 2000

(30) Foreign Application Priority Data

Jun. 24, 1999 (FI) ..... 991445

(51) Int. Cl.[7] ..... D21F 11/00

(52) U.S. Cl. ..... 162/134; 162/135; 162/110; 162/137; 162/265; 427/197; 427/203; 427/424; 427/391

(58) Field of Search ..... 162/134, 140, 162/135, 137, 265, 110; 427/185, 197, 203, 424, 391, 361

(56) References Cited

U.S. PATENT DOCUMENTS 246,100 A * 8/1881 Dupré et al. ..... 162/140
1,990,994 A * 2/1935 Lum ..... 162/140
2,005,105 A * 6/1935 Neff ..... 162/140
2,019,845 A * 11/1935 Colbert et al. ..... 162/140
3,076,689 A * 2/1963 Taylor ..... 162/110
4,504,357 A 3/1985 Holbein et al.
5,820,730 A 10/1998 Phan et al.
5,897,746 A * 4/1999 Attenberger et al. ..... 162/140

FOREIGN PATENT DOCUMENTS

| | | |
|---|---|---|
| EP | 0 140 404 | 5/1985 |
| FI | 100815 | 2/1998 |
| GB | 2 220 346 A | 1/1990 |
| RU | 2124951 | 1/1999 |

* cited by examiner

*Primary Examiner*—Jose Fortuna
(74) *Attorney, Agent, or Firm*—Pillsbury Winthrop LLP

(57) ABSTRACT

A method and apparatus for making patterned paper. A printer patterning the paper is arranged in a patterning unit arranged in a paper machine, the printer patterning a paper web being made in the paper machine. The printer is preferably an ink-jet printer. The paper web patterned by the patterning unit can be coated by a coating unit arranged in the paper machine.

20 Claims, 2 Drawing Sheets

METHOD AND APPARATUS FOR MAKING PATTERNED PAPER

BACKGROUND OF THE INVENTION

The invention relates to a method for making patterned paper, in which method the paper is made in a paper machine and patterned.

The invention further relates to an apparatus for making patterned paper, which apparatus comprises a paper machine and a patterning means for paper.

Some paper grades are patterned with various patterns before the paper is delivered to its user. The patterns may be used for aesthetic purposes, for communicating necessary information—in the packaging, for instance—or for some other purpose. In this application, patterning refers to both text and images.

In prior art, paper is patterned in a separate work phase. For instance, patterned baking paper is made by first making the paper in a paper machine, and then transferring the paper to a separate patterning unit in which patterning is typically done by printing. In a third phase, the paper is siliconized, i.e. coated with silicone which gives the paper the good detaching properties typical of baking paper. Patterning must be done prior to siliconizing so as to have the color stick permanently to the paper. The manufacturing process thus comprises three phases which are all done with different machines and possibly in different factories or even in different localities, and between the phases, the paper reels need to be moved and stored. The manufacturing process in its entirety is, therefore, expensive and complex as it is time-consuming and requires several different machines and work phases. In addition, changing the patterns for the paper is time-consuming, and consequently, the patterning of small batches of paper with special patterns, for instance, is not economically profitable.

BRIEF SUMMARY OF THE INVENTION

It is an object of the present invention to provide a method and an apparatus for making patterned paper, in which the above-mentioned drawbacks do not exist.

The method of the invention is characterized in that a patterning unit is arranged in a paper machine, and a printer belonging to said patterning unit patterns the paper web being made in said paper machine.

An apparatus of the invention is characterized in that the patterning means comprises a printer arranged to the patterning unit arranged in the paper machine, and that the printer is arranged to pattern the paper web being made in said paper machine.

The essential idea of the invention is that a patterning unit is arranged in a paper machine making the paper to be patterned, and the patterning unit patterns desired patterns in to the paper web running in the paper machine. Further, the idea of a preferred embodiment is that the patterning unit comprises one or more printers, whereby the rate of patterning or complexity of patterns can be increased. The idea of another preferred embodiment is that the printer is preferably an ink-jet printer which comprises one or more printing heads, thus making the patterning especially easy. The idea of a third preferred embodiment is that a coating unit is arranged in the paper machine after the patterning unit in the direction of travel of the paper web, and the already patterned paper web is coated at the same time with making and patterning it. The idea of a fourth preferred embodiment is that the patterned and coated paper is a siliconized baking paper.

The invention provides the advantage that paper patterning is performed at the same time and in the same apparatus as paper making, whereby making patterned paper becomes fast. The paper need not be transferred away from the paper machine for patterning, thus avoiding transporting, storing and other extra intermediate phases, which reduces considerably the manufacturing costs and lead-time of patterned paper. Even complex patterns can easily and simply be patterned on the paper, and the patterns can be changed and altered even during patterning through a control program of the patterning unit. Further, a preferred embodiment provides the advantage that by coating the patterned paper immediately after the patterning by means of a coating unit arranged in the paper machine, it is possible to further reduce transport and storage costs and speed up the manufacturing process. In addition, by immediate coating, the patterns are right away covered under the coating and cannot wear or otherwise deteriorate before delivery to the customer.

BRIEF DESCRIPTION OF THE SEVERAL VIEWS OF THE DRAWING

The invention will be described in greater detail by means of the attached drawings in which.

DETAILED DESCRIPTION OF THE INVENTION

Figure 1:
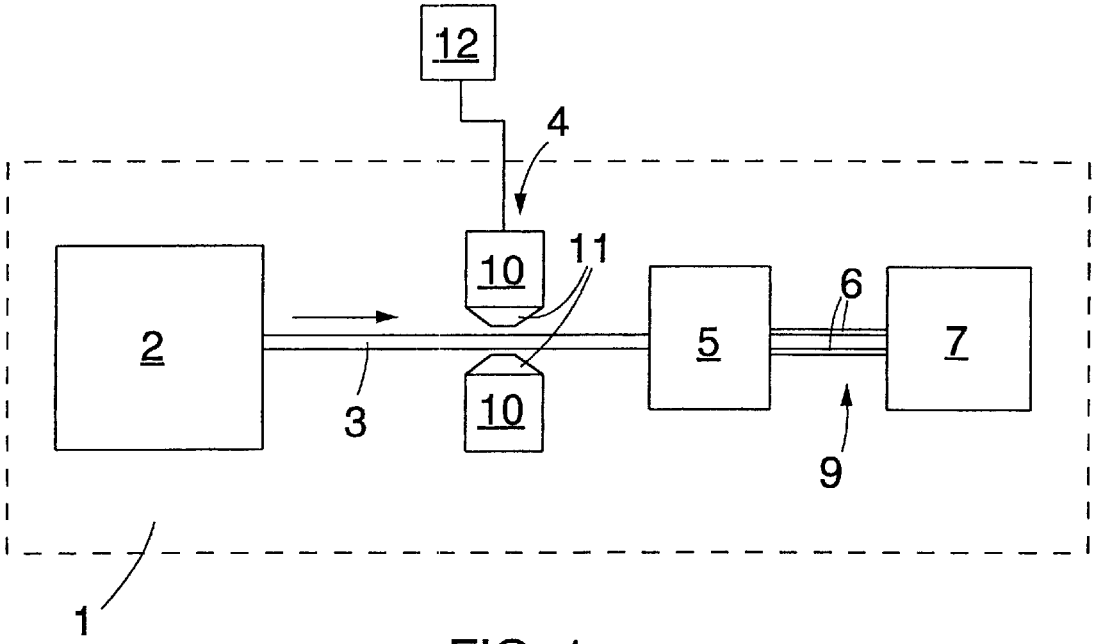
FIG. 1 is a greatly simplified schematic of an embodiment of the apparatus of the invention from the side.

FIG. 1 is a greatly simplified schematic of an embodiment of the apparatus of the invention from the side. A paper machine 1 making paper to be patterned is shown by a dashed line in the figure. The paper machine 1 is known per se to a person skilled in the art and consequently, it is not described in detail herein. Further, the operation of the paper machine 1 is known per se to a person skilled in the art and, therefore, need not be described in detail herein. The paper machine 1 comprises means for forming and drying a paper web, in other words, a forward end, a press section and a dryer section, which means are marked by reference number 2 in FIG. 1. The paper web 3, whose direction of travel is shown with an arrow in FIG. 1, coming from the forming and drying means 2, is led to a patterning unit 4. The patterning unit 4 comprises a printer 10 whose printing head 11 prints the desired patterns onto the paper web 3. The printer 10 may comprise one or more printing heads 11 whose imprints may also be of various colors. Said patterns may comprise graphical patterns, writing, combinations thereof or other corresponding patterns. The patterns typically repeat as such on the paper web 3 at certain intervals, but they may also be randomly located or change continuously. The patterning unit 4 is controlled by a control unit 12 which comprises at least a program for controlling the printing heads 11 of the printer 10 and a user interface. With the control unit 12, it is possible to control the patterning unit 4 in real time so that the patterns can be quickly changed into other patterns. This way, it is possible to pattern even quite small paper batches while the manufacturing costs remain low.

In the embodiment shown in FIG. 1, there is a patterning unit 4 arranged both above and below the paper web 3 opposite each other. This way, the paper web 3 can be patterned on both sides with the desired patterns. The patterning units 4 arranged on both sides of the paper web 3 can also reside in different locations in relation to each other in the direction of travel of the paper web 3. In a second embodiment of the invention, the patterning unit 4 is arranged on one side of the paper web 3 only so as to pattern the web 3 on that side only.

In the embodiment shown in FIG. 1, the patterning unit 4 is arranged after the dryer section of the paper machine 1. The patterning unit 4 can also be arranged in the paper machine 1 so that a part of the dryer section is after the patterning unit 4 in the direction of travel of the paper web 3.

The printer 10 is preferably an ink-jet printer, by means of which it is easy and fast to make even complex patterns on the surface of the paper web 3. The structure and operation of an ink-jet printer is known per se and is, therefore, not described in more detail herein. The imprint of a printing head 11 of the applied ink-jet printer can be either one-color or multicolor whereby multicolor patterns can be made on the paper web 3.

In the embodiment shown in FIG. 1, the patterned paper web 3 runs from the patterning unit 4 to a coating unit 5 arranged in the paper machine 1, and in the coating unit, the paper web 3 is coated with a coating layer 6 either on both sides, as shown in FIG. 1, or on one side only. For instance, when making baking paper, the paper web 3 is today usually coated with a layer comprising silicone, i.e. the web is siliconized. Depending on the use of the paper, the coating layer 6 may also be of a material other than silicone. The coating 6 must always be at least to some extent transparent so as to allow the patterns made on the paper web 3 to show through it. The coated paper web 9 is led after the coating unit 5 on to means for further processing 7 which comprise a winder and reelers, for instance. The coated and patterned paper is thus made substantially entirely in the paper machine 1, making the manufacture extremely fast and simple. No separate machinery is required for patterning and coating the paper, and the paper need not be moved to another location for patterning or coating, which shortens the lead-time and reduces the need for production and storage space. If coated paper grades are not made in the paper machine 1, the coating unit 5 can naturally be left out of the paper machine 1.

Figure 2:
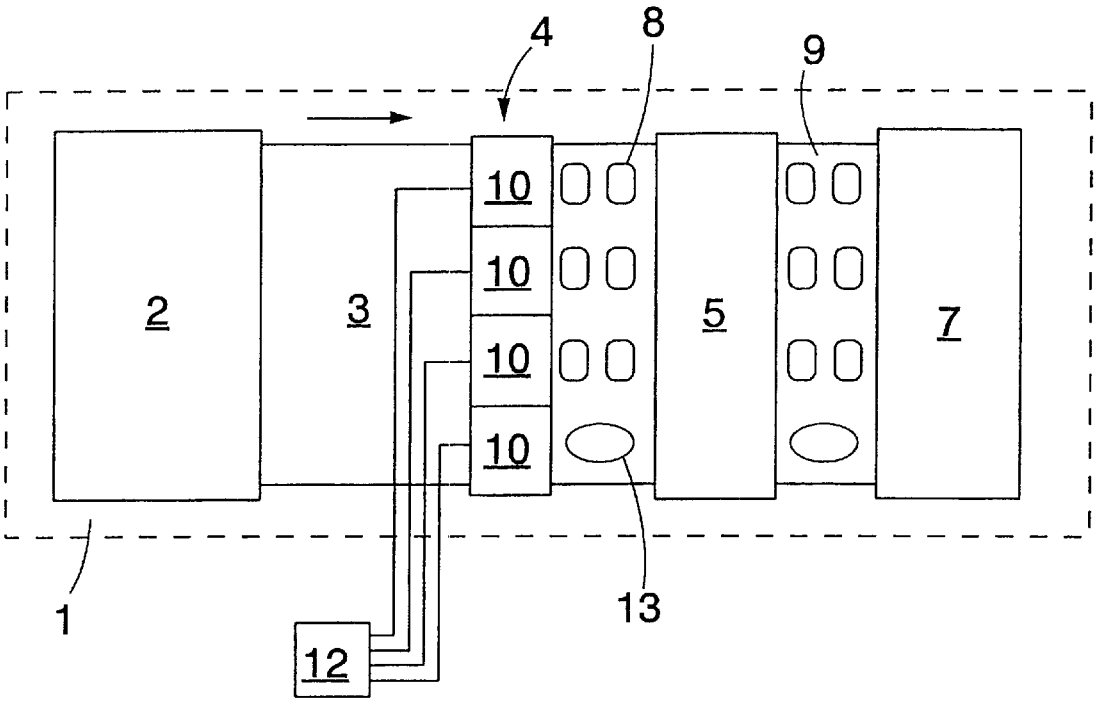
FIG. 2 is a schematic of the embodiment of the invention shown in FIG. 1 from the top.

FIG. 2 is a schematic of the embodiment of the invention shown in FIG. 1 from the top. The reference numbers of FIGS. 1 and 2 correspond to each other. The paper web 3 formed in the forming and drying means 2 runs in the direction shown by the arrow into the patterning unit 4 arranged in the paper machine 1, where it is patterned by patterns 8 and 13. After this, the web runs on to the coating unit 5 arranged in the paper machine 1 for coating, and then the coated paper web 9 is led to the means for further processing 7 of the paper machine 1, where the coated paper web 9 is processed in a manner known per se before delivered to further processing.

In the embodiment shown in FIG. 2, the patterning unit 4 comprises four printers 10 placed side by side, each printer arranged to pattern a part of the width of the paper web 3 in such a manner that the entire width of the paper web can substantially be patterned. The number of printers 10 in the patterning unit 4 is naturally not limited to four, but it can be a larger or smaller number. Each printer 10 is controlled by a control unit 12, through which the printers 10 can all be made to make the same pattern 8 on the web 3, or alternatively one or more printers 10 can be made to make a pattern 13 differing from that of the other printers 10. Patterns 8, 13 can be continuously repeating, or continuously changing in a desired manner and differing from each other. By increasing the number of parallel printers 10, the part of the web 3 width each of them patterns becomes narrower and the length of movement of the printing heads 11 becomes smaller, whereby the speed of the paper web 3 being patterned can correspondingly be increased. The printing heads 11 are not shown in FIG. 2 to simplify the figure.

Figure 3:
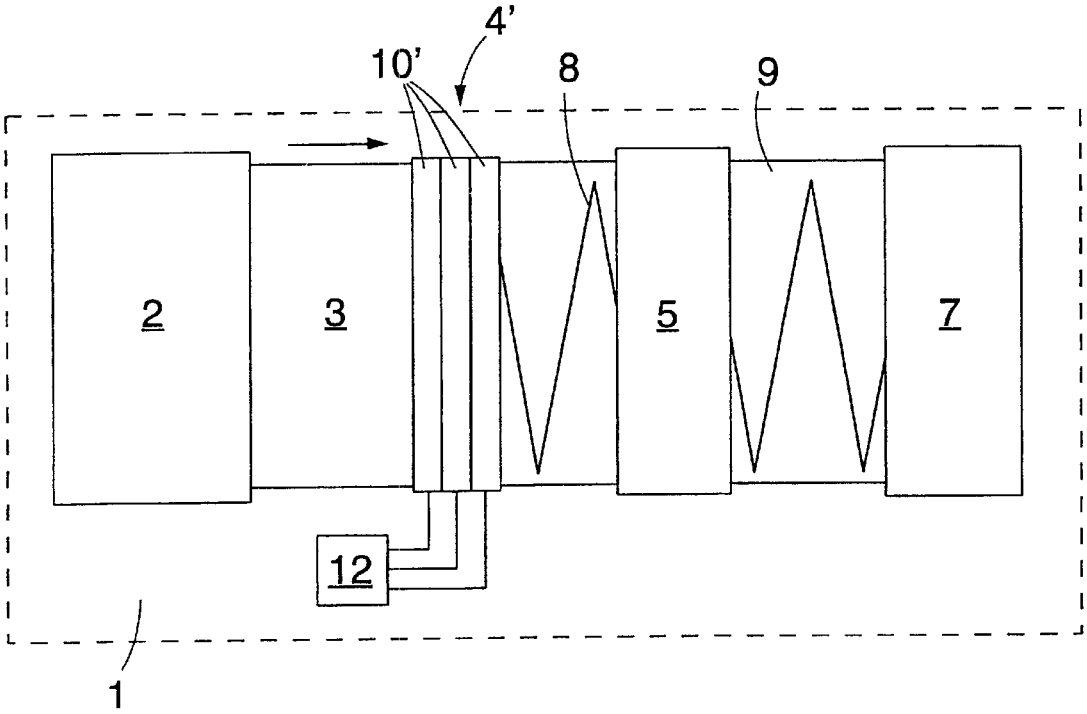
FIG. 3 is a schematic of a second embodiment of the apparatus of the invention from the top.

FIG. 3 is a schematic of a second embodiment of the apparatus of the invention from the top. It should be noted that the reference numbering in FIG. 3 corresponds to that of FIGS. 1 and 2. The paper web 3 is led as described in the above figures from the forming and drying means 2 to the patterning unit 4'. The patterning unit 4' comprises three printers 10' which are arranged consecutively in a series in the direction of travel of the paper web 3 and which all can be used to pattern substantially the entire width of the paper web 3. In other words, the printing heads 11 of each printer 10', which are not shown in FIG. 3 to simplify the description of the matter, move substantially on the entire width of the paper web 3. The patterning of the paper web 3 is arranged so that each printer 10' patterns only a part of the desired pattern. In an embodiment, the printers 10' pattern the paper web 3 with imprints of different colors, which form the final multicolor patterning. In another embodiment, the imprints of each printer 10' are of the same color, making the final patterning one-colored. It is naturally possible to have more or less than three printers 10' arranged consecutively in the patterning unit 4'.

The control unit 12 of the patterning unit 4' is arranged in the paper machine 1, preferably together with the control and monitoring units of the paper machine 1 known per se, whereby the process of making patterned paper can, in its entirety, be controlled and monitored from the same control room.

The drawings and the description related to them is only intended to illustrate the idea of the invention. The invention may vary in detail within the scope of the claims. Thus, the patterning unit may comprise printers arranged both side by side and consecutively. In addition, the printers may be arranged suitably interlocked with each other. There may be more than one patterning unit arranged in the paper machine, which further speeds up the patterning of extremely complex patterns, for instance.

What is claimed is:

1. A method for making patterned paper, comprising:

providing a paper making machine and disposing a patterning unit having at least one printer in the machine;

forming and drying a paper web in the machine;

advancing the paper web past the patterning unit;

forming a pattern on the paper web by means of the printer as the web moves past the patterning unit; and forming the paper web into baking paper and siliconizing the baking paper.

2. The method according to claim 1 wherein the patterning unit has at least two printers.

3. The method according to claim 1, wherein providing a paper making machine comprises disposing at least two patterning units in the machine.

4. The method according to claim 1 wherein the printer is an ink-jet printer having at least one printing head.

5. The method according to claim 1, further comprising disposing a coating unit in the paper making machine, and advancing the web through the coating unit after the web has advanced past the patterning unit, and coating the paper web on at least one side with a coating layer in the coating unit.

6. The method according to claim 1, wherein the patterning unit has two or more printers, and forming a pattern on the paper web is carried out by printing on each side of the web by means of a respective one of the printers.

7. The method according to claim 1 wherein said step of forming a pattern comprises patterning the paper web with patterns which continuously repeat along the web.

8. The method according to claim 1, wherein forming a pattern comprises forming varying patterns on the paper web.

9. An apparatus for making patterned paper, comprising:

a paper making machine for forming and drying a paper web which advances from the paper making machine in a travel direction; and at least one patterning unit including at least one printer disposed in said paper making machine, wherein, said patterning unit is located to form a pattern on the paper web after the paper web has been formed and dried in said paper making machine, wherein said paper making machine is constructed and operated to make baking paper.

10. The apparatus according to claim 9, wherein said patterning unit has at least two printers.

11. The apparatus according to claim 9, wherein there are at least two said patterning units.

12. The apparatus according to claim 9, wherein said printer is an ink-jet printer having at least one printing head.

13. The apparatus according to claim 9, wherein said machine further comprises a coating unit arranged downstream of said patterning unit with respect to the travel direction, said coating unit being arranged to coat the paper web on at least one side after the web has been patterned by said patterning unit.

14. The apparatus according to claim 9, wherein said patterning unit has a plurality of printers disposed side-by-side in a direction transverse to the travel direction.

15. The apparatus according to claim 9, wherein the patterning unit has a plurality of printers spaced apart in the travel direction.

16. The apparatus according to claim 9, wherein said printer has a printing head which is a one-color printing head.

17. The apparatus according to claim 9, wherein said printer has a printing head which is a multicolor printing head.

18. The apparatus according to claim 9, wherein said patterning unit has at least two printers each disposed to form a pattern by printing on a respective side of the paper web.

19. The apparatus according to claim 9, wherein said patterning unit is constructed and operated to pattern the paper web with patterns which continuously repeat along the web.

20. The apparatus according to claim 9, wherein said patterning unit is constructed and operated to pattern the paper web with varying patterns.

* * * * *